US006244679B1

(12) United States Patent
Robertson et al.

(10) Patent No.: US 6,244,679 B1
(45) Date of Patent: Jun. 12, 2001

(54) EMBOSSES AND METHOD OF USING SAME FOR ATTACHMENT OF MEMBERS

(75) Inventors: Steven Michael Robertson, Placentia; Seyed Taghi Mehrabi, Santa Ana, both of CA (US)

(73) Assignee: Accuride International Inc., Santa Fe Springs, CA (US)

( * ) Notice: Subject to any disclaimer, the term of this patent is extended or adjusted under 35 U.S.C. 154(b) by 0 days.

(21) Appl. No.: 09/306,010

(22) Filed: May 5, 1999

(51) Int. Cl.[7] ..... A47B 88/04

(52) U.S. Cl. ..... 312/334.1; 29/505; 308/3.8

(58) Field of Search ..... 312/334.1, 334.7, 312/334.8, 334.9, 334.11, 334.12, 348.2, 350, 351; 384/18, 19, 22; 20/505; 308/3.8; 205/67, 115

(56) References Cited

U.S. PATENT DOCUMENTS

| | | | | |
|---|---|---|---|---|
| 2,750,901 | * | 6/1956 | McClellan | 312/351 X |
| 3,954,315 | | 5/1976 | Sanden . | |
| 3,980,364 | | 9/1976 | Entrikin et al. . | |
| 4,119,827 | * | 10/1978 | Lenox | 29/505 X |
| 4,121,876 | * | 10/1978 | Ratti | 308/3.8 |
| 4,328,998 | | 5/1982 | Manson . | |
| 4,370,007 | * | 1/1983 | Fler | 312/334.1 X |
| 4,662,761 | | 5/1987 | Hoffman . | |
| 4,932,792 | | 6/1990 | Baxter . | |
| 5,385,400 | | 1/1995 | Chen . | |
| 5,624,171 | * | 4/1997 | Soja et al. | 312/334.8 |
| 5,692,265 | * | 12/1997 | Hoffman | 312/334.11 X |
| 5,868,479 | * | 2/1999 | Hoffman | 312/334.8 X |

FOREIGN PATENT DOCUMENTS

| | | | | |
|---|---|---|---|---|
| 186321 | * | 10/1921 | (GB) | 312/334.11 |

* cited by examiner

*Primary Examiner*—Peter M. Cuomo
*Assistant Examiner*—Michael J. Fisher
(74) *Attorney, Agent, or Firm*—Christie, Parker & Hale, LLP

(57) ABSTRACT

A plurality of members, which are to be attached to each other, having protruding points of attachment, an assembly formed of such members, a method for attaching members to each other using such attachment points, and a method for creating an assembly by attaching such members to one another.

13 Claims, 8 Drawing Sheets

EMBOSSES AND METHOD OF USING SAME FOR ATTACHMENT OF MEMBERS

BACKGROUND OF THE INVENTION

The present invention generally relates to a method for attaching members to each other, and, more particularly to a method of forming a slide assembly by attaching members to each other using specific points of attachment.

Drawer slides for file drawers and the like are often desirable for use in cabinets and other rack-mounted applications. Such slides permit easy access to the interior of the drawer. The slides maintain the drawer in a horizontal position regardless of how far the drawer is withdrawn from the cabinet.

Drawer slide assemblies are generally constructed of two or more slide members. Sometimes a slide member is formed by shaping a single piece of material, and sometimes the slide member is formed by attaching together several separate pieces of material. One common configuration is a three member vertical drawer slide. In this configuration, there is an intermediate tie member with substantially vertical planar upper and lower sections. Slide member connectors are attached to the upper and lower sections of the intermediate member, and the connectors in turn are slidably coupled to the slide members which support the drawers.

Typically, the slide member connectors are attached to the intermediate member by welding or riveting. Other members may be attached to one another in a similar fashion. This building block approach has been used to produce enhanced features on the slide assemblies, such as increased payload capacity or greater extension. The component members are typically relatively thin elongated metal elements, having longitudinal webs, and the members are generally joined together web to web.

Typically, the members are welded or otherwise attached together in advance of plating or coating in order to reduce the cost of plating. Applying the plating process to a single assembly is usually more economical than applying plating to multiple individual components with each component plated separately before being brought together at the assembly stage. Furthermore, when welding multiple components that have been previously plated, one must address the hazard of emitting toxic fumes and the degradation of aesthetics and appearance.

However, when members are assembled prior to plating or coating, a "bleed out" of chemicals typically occurs after plating. This bleed-out is due to chemically reactive elements being trapped between the attached members during the plating and cleaning process. The close contact between the welded or riveted members is not water tight, so chemicals can enter and temporarily remain in the very small spaces between the members. However, after the lapse of certain time intervals, these chemically reactive elements slowly drain or bleed from their temporary holding places. In flowing over the exposed surfaces of the newly plated assembly, a chemical reaction takes place leaving unsightly smudges and smears. Thus there exists a need for an assembly of individual components, and a method for assembling individual components, such that the assembly may be plated or coated without incurring bleed out.

SUMMARY OF THE INVENTION

The present invention provides an assembly of components, and a method for assembling and attaching component members, which allows plating chemicals and other liquids to quickly flow from between the attached components after being plated and thus eliminates the unsightly effect of "bleed-out" on exposed surfaces of the components.

The components or members to be attached to each other are prepared prior to attachment by creating one or more protrusions, called embosses, on the surface of at least one of the components to be attached. The emboss is stamped into the first component creating a raised attachment point on the attachment surface of the component. Embosses, generally 0.01" thick, are placed at spaced intervals along the length of the component. Thereafter, the second component, which is to be attached to the first component, is brought into contact with the embosses and is welded or otherwise attached to the first component at each of the embosses. Because of the raised embosses, a small channel is formed between the component members of the assembly. The assembly is then passed through cleaning and plating baths to produce a uniform, clean finish on all exposed surfaces of the assembly, with the raised embosses allowing such baths to drain more quickly away from between the attached components of the assembly, before leaving the plating cycle, thus preventing bleed out, and effectively masking the locations of the embossments.

A secondary benefit of the invention is that the channel formed by the embosses allows better flow of the plating chemicals between the component members, resulting in more complete plating, and, for example, better rust prevention. The separation of the members also reduces the chance of contact except at the desired weld points, concentrating the weld current flow and improving the strength of the weld connection.

DESCRIPTION OF THE DRAWINGS

These and other aspects of the present invention will become more apparent from the following Detailed Description read in conjunction with the accompanying drawings.

DETAILED DESCRIPTION

Figure 2:
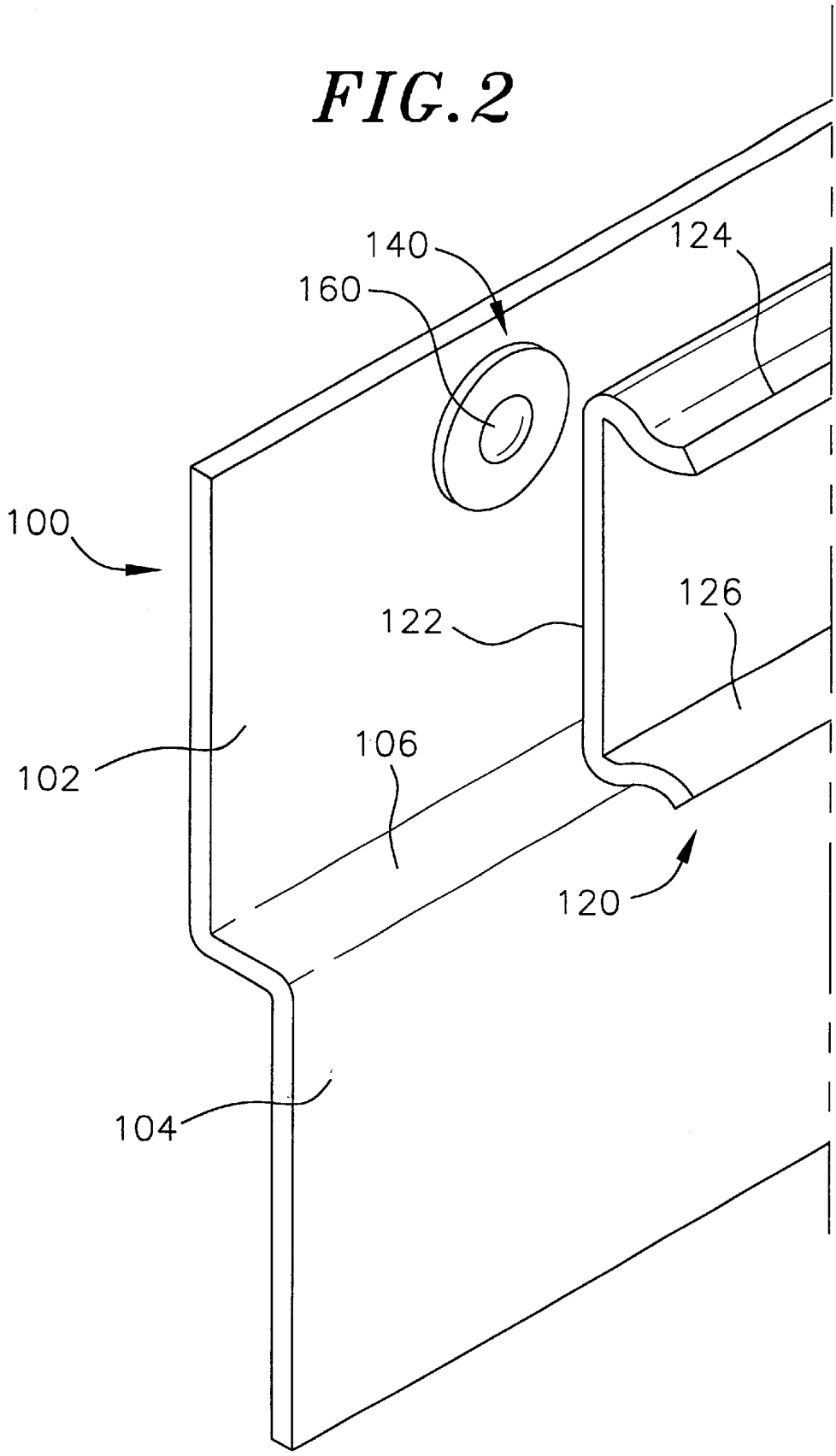
FIG. 2 is an isometric view of several components of a drawer slide assembly, shown unassembled.

Referring now to FIG. 2, there are shown drawer slide components comprising an intermediate member 100, and a facing or slide member connector 120 that is to be attached to the intermediate member. The intermediate member 100 comprises an upper vertical flange 102 horizontally offset from a lower vertical flange 104. A substantially horizontal cross piece 106 connects the upper and lower flanges. The upper flange ascends from one margin of the cross piece 106 and the lower flange descends from the opposing margin of the cross piece. As a matter of convenience, the sides of the flanges directed away from the connecting cross piece shall be termed the outside faces of the flanges. Similarly, the sides of the flanges directed towards the connecting cross piece, shall be termed the attaching faces of the flanges. The upper slide member connector 120 has a vertical web 122 and arcuate upper and lower horizontally outward facing ball bearing raceways 124, 126 extending from the upper and lower margins, respectively, of the web 122. The lower slide member connector is constructed similarly. The tie member 100 has been previously prepared by stamping the web or flange of the intermediate member with a series of spaced apart embosses 140.

Referring to FIG. 2, one such emboss 140 is shown. It is located on an attaching face of the intermediate member, and has the form of a circle with a raised projection 160 in the center. The projection is the point of welding contact with the slide member connector 120.

Figure 3:
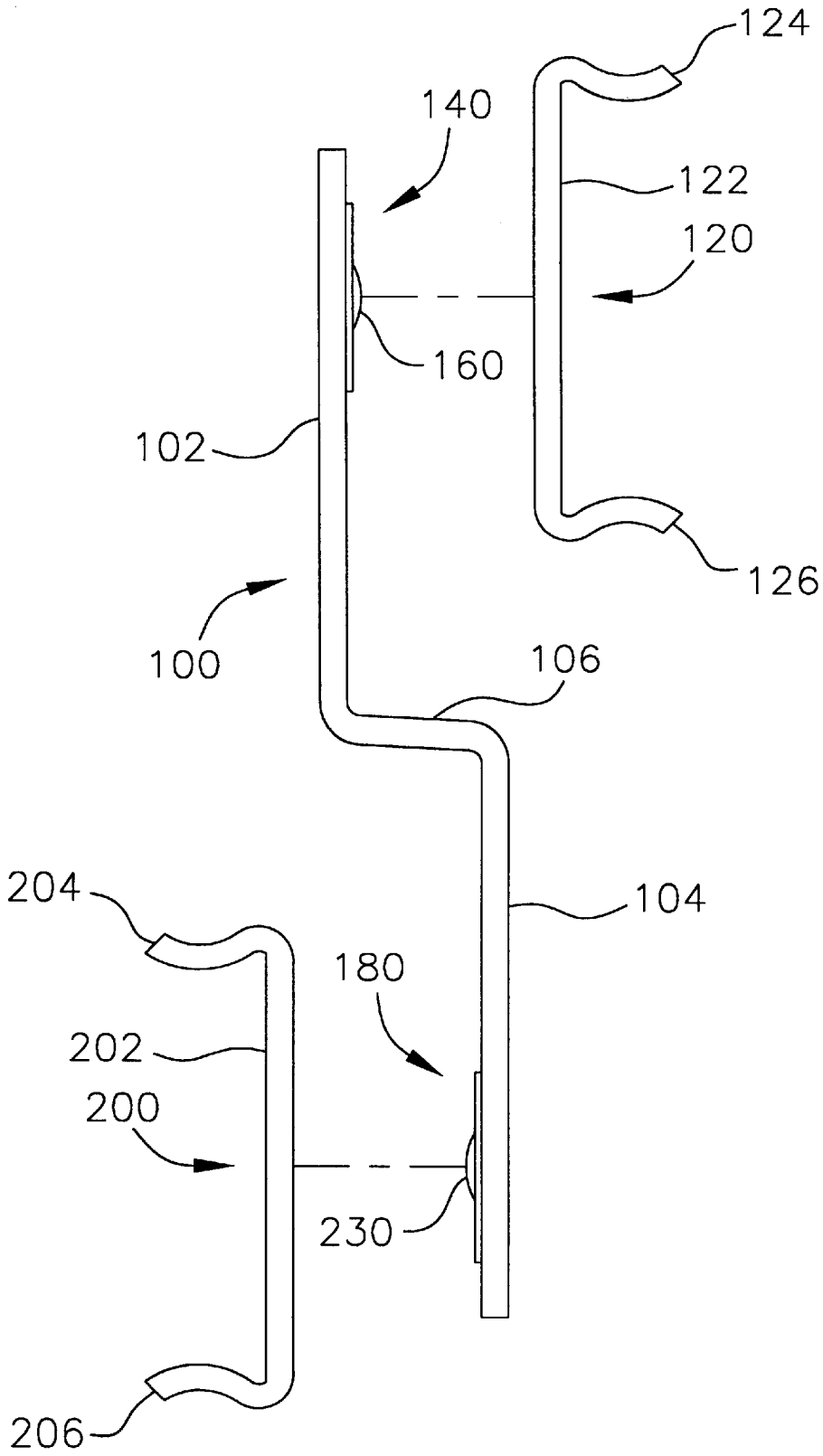
FIG. 3 is an end view of several components of a drawer slide assembly, shown unassembled.

This relationship between members is further illustrated in FIG. 3, which shows the intermediate member 100 positioned between slide member connectors 120, 200 to be attached to the intermediate member. Emboss 140 is shown on the top half of the intermediate member facing a slide member connector 120, and another emboss 180 is shown on the lower half of the intermediate member, facing a second slide member connector 200. In a preferred embodiment, the embosses are created by a stamping machine which brings a flat faced rod with a projection or pip in the center to bear against the web of the intermediate member causing the creation of a weld projection 160, 230 on the attaching face of the member. This stamping process is repeated at spaced intervals along the length of the intermediate member on both the upper and lower flanges. It will be appreciated by those skilled in the art that, in addition to stamping, other methods of creating the embossments can also be used.

Figure 5:
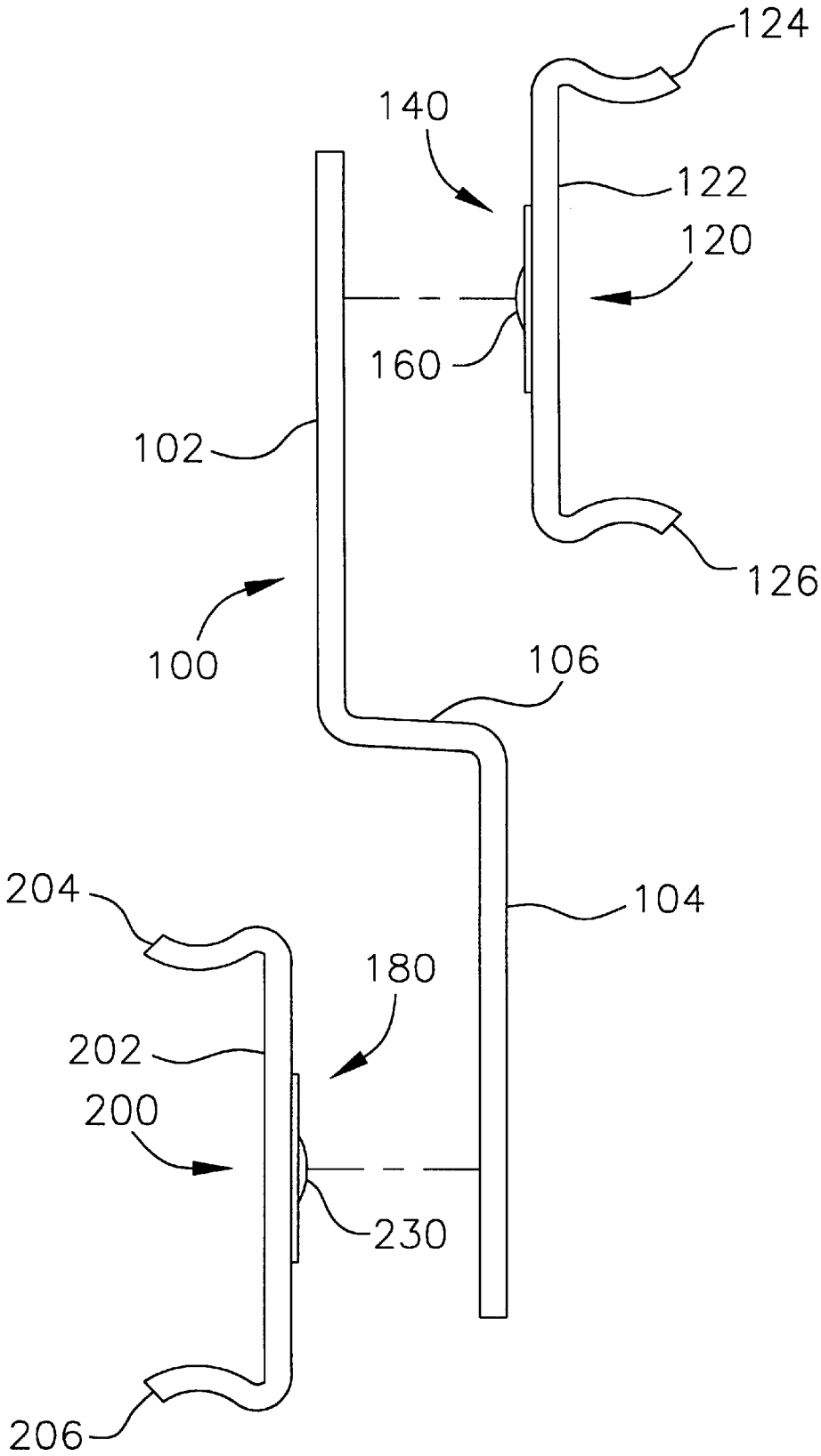
FIG. 5 is an end view of several components of a drawer slide assembly, shown unassembled.

In an alternative embodiment shown in FIG. 5, instead of stamping the embosses on the intermediate member, the embosses 140, 180 are stamped into the web of the respective component slide member connectors 120 and 200. It will be appreciated by those skilled in the art that where two members are to be connected, the embosses can be stamped into either member, or can be stamped onto both members, preferably such that any two consecutive embosses on a first member are adjacent to an emboss of a second member, located therebetween the embosses of the first member.

Figure 4A:
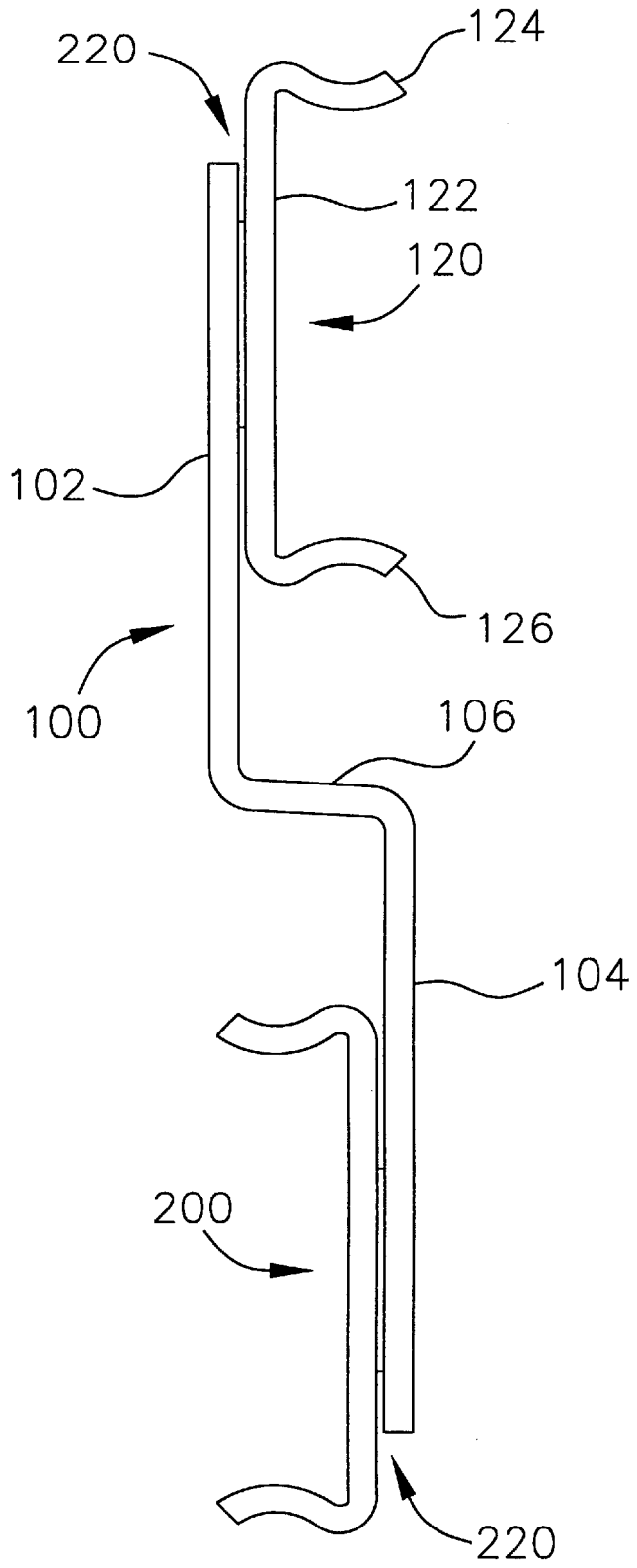
FIG. 4A is an end view of slide members attached at spaced intervals by welding or bonding.
Figure 4B:
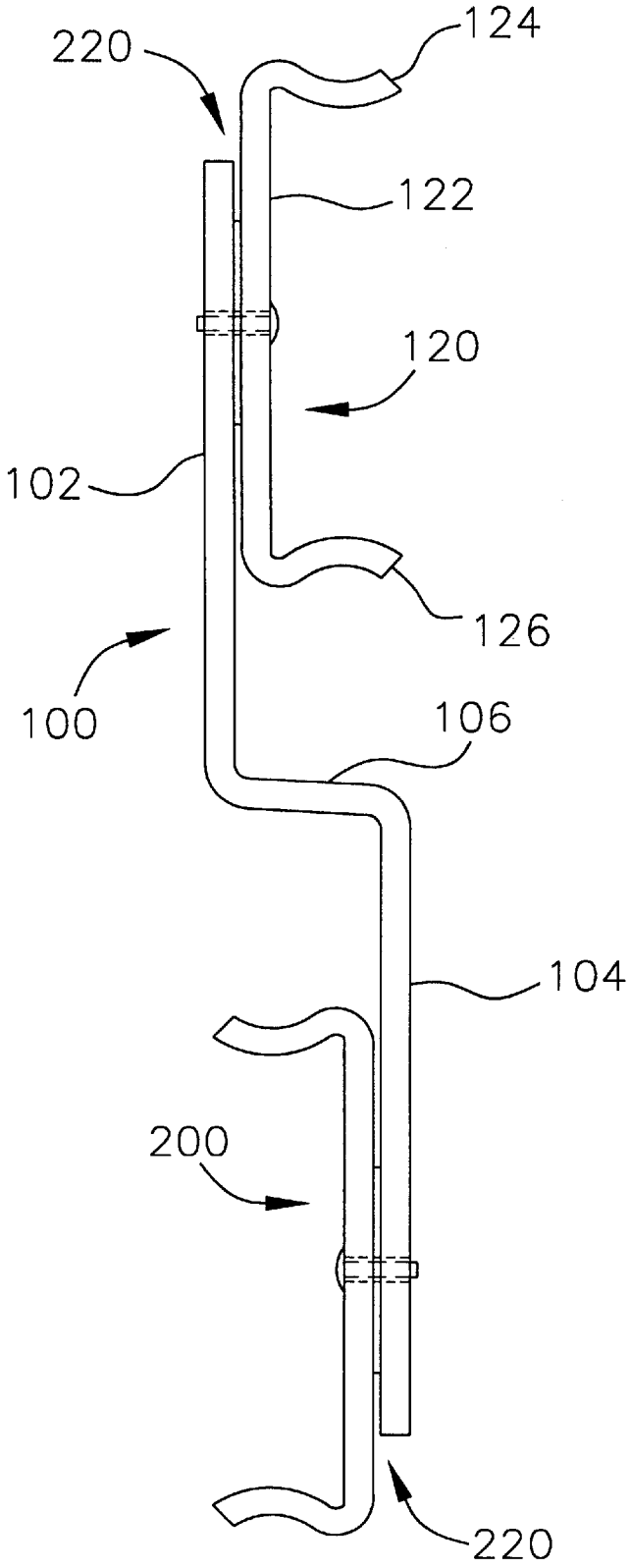
FIG. 4B is an end view of slide members attached at spaced intervals by riveting.
Figure 4C:
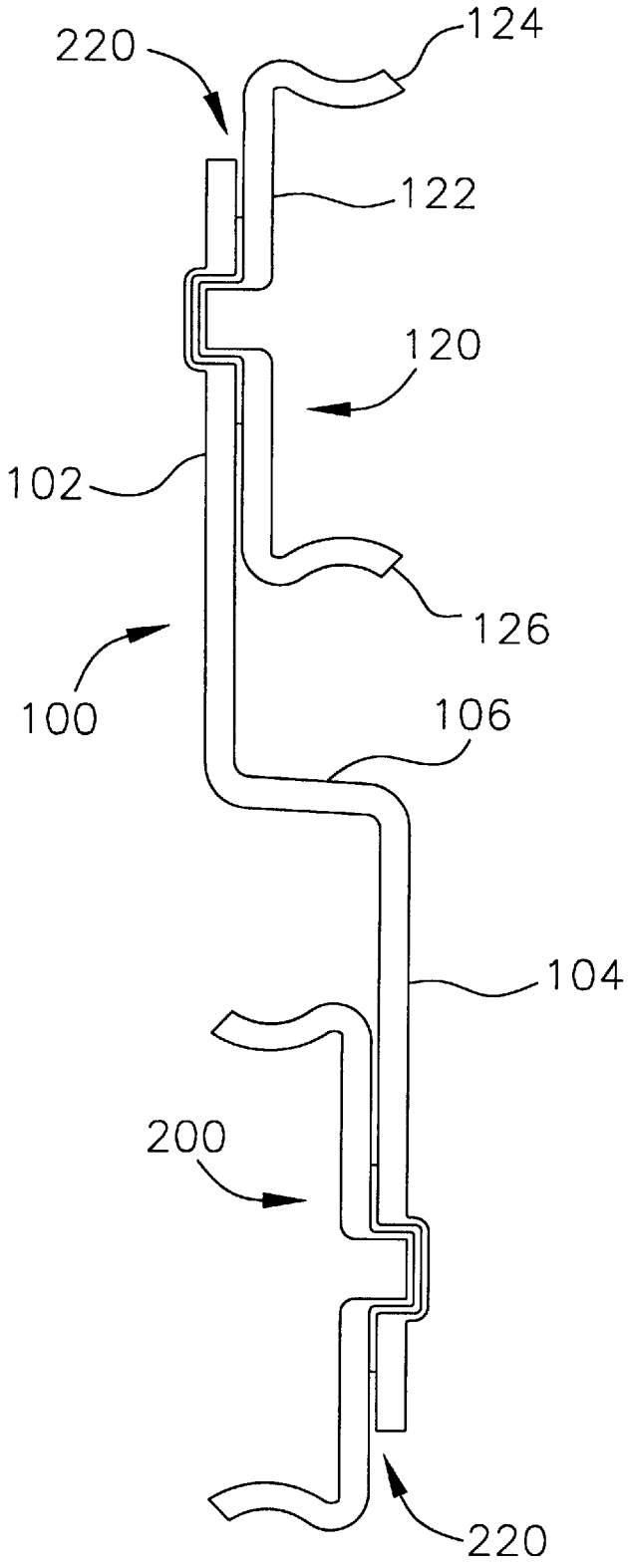
FIG. 4C is an end view of slide members attached at spaced intervals by swagging or deforming.
Figure 4D:
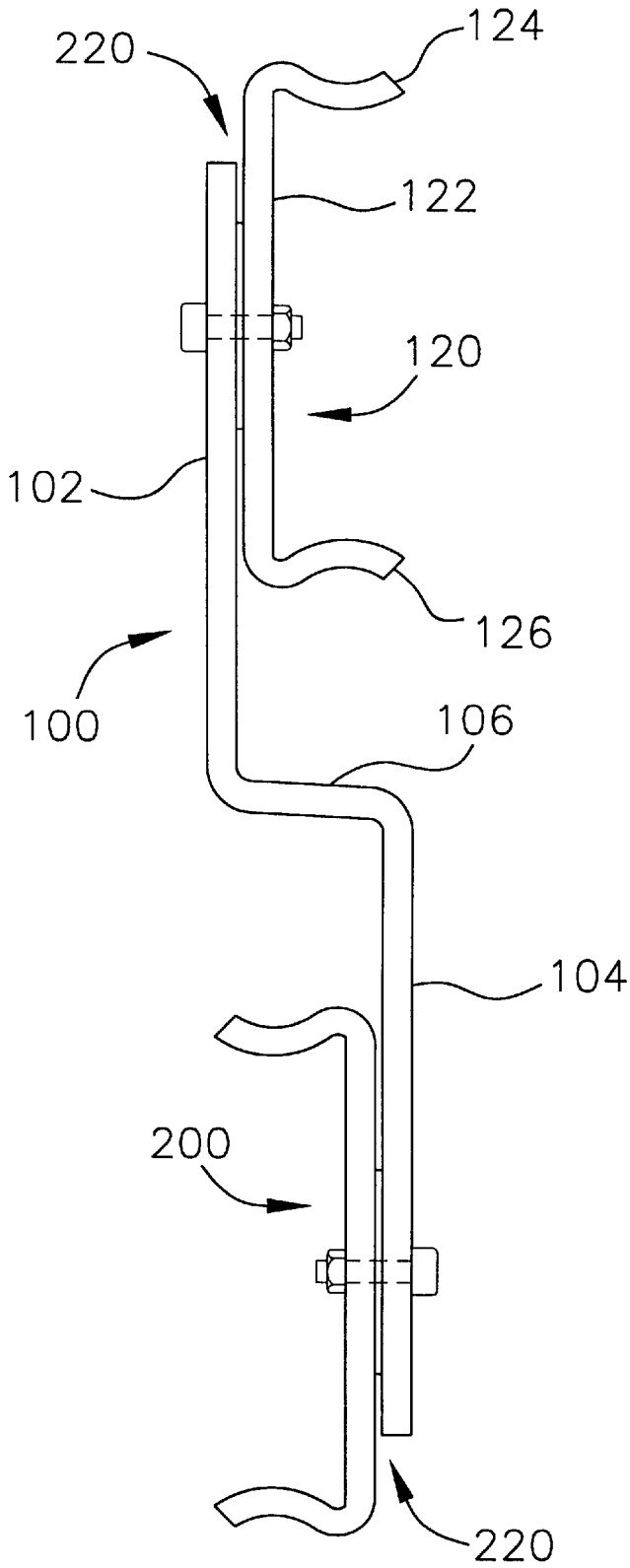
FIG. 4D is an end view of slide members attached at spaced intervals by use of fasteners.

Once the embosses have been created on either the intermediate member 100 or the component slide member connectors 120, 200, the members are ready to be attached to each other. In one embodiment, the slide member connectors 120, 200 and the intermediate member 100 are brought together face to face, with the vertical web of each slide member connector opposite the arcuate extending raceways facing the attaching face of the tie member 100, and welding energy is applied to the weld projections 160, 230 at the site of each of the embosses, producing a strong solid attachment of the members as shown in FIG. 4A. Alternative methods of attaching the members to each other include crimping, riveting, adhering, soldering, swedging and fastening, or any other method of attachment known in the art, as shown in FIGS. 4B, 4C & 4D. Regardless of the method of attachment, the embosses cause a small channel 220 to be created between the attached members. This channel 220 creates breathing room between the members, which allows the plating or coating materials to flow between the component members of the assembly and fully coat all exposed portions of the members. The channel also allows the cleaning or plating fluids retained by the assembly after plating treatment to quickly drain or bleed away from between the members. Thus, in addition to preventing bleed out, the present invention also allows more complete coverage of the exposed areas by the plating or coating solution. The channel 220 provided by the present invention allows the assembly to dry more rapidly, without retaining a residuum of cleaning or plating fluids, which in the past remained trapped between members of the assembly for a short time after completion of the plating process, and then bled away, staining the plating or the assembly.

As described above, during fabrication of drawer slide component members, small embosses are made on at least one of the members to be attached. If the parts are to be projection welded, small weld projections are incorporated into the center of the embosses. If the parts are to be riveted or crimped, tooling or pilot holes are pierced into the emboss area prior to the attaching operation.

The depth and size of the embosses will depend on the size of the component parts being attached and the support required. For typical slide components, the embosses are preferably ½" in diameter and 0.01" deep.

This same embossment method can be applied to a multiple range of attachment methods, in addition to welding or riveting. Components using self piercing rivets, swedge connections, and commercial locking products like "TOX"™ are also suitable candidates for this method.

Likewise, the same approach is not limited to attaching drawer slide member connectors, but can also be applied to other slide attachments, including brackets, levers, and locks, as well as other applications where individual components of hardware are joined prior to plating or coating of the joined assembly. In all such applications, the present invention will allow more complete plating or coating of the assembly, will facilitate drainage of the plating or coating materials, thereby eliminating bleed off, and will promote increased weld strength by reducing contact points between the components of the assembly and concentrating the weld current flow.

The following more completely describes a drawer slide assembly, and provides an example of where embosses in accordance with the present invention are utilized. Although embosses could also be used in a number of other situations and configurations, the three member vertical drawer slide described is an exemplary embodiment of the present invention.

Figure 1:
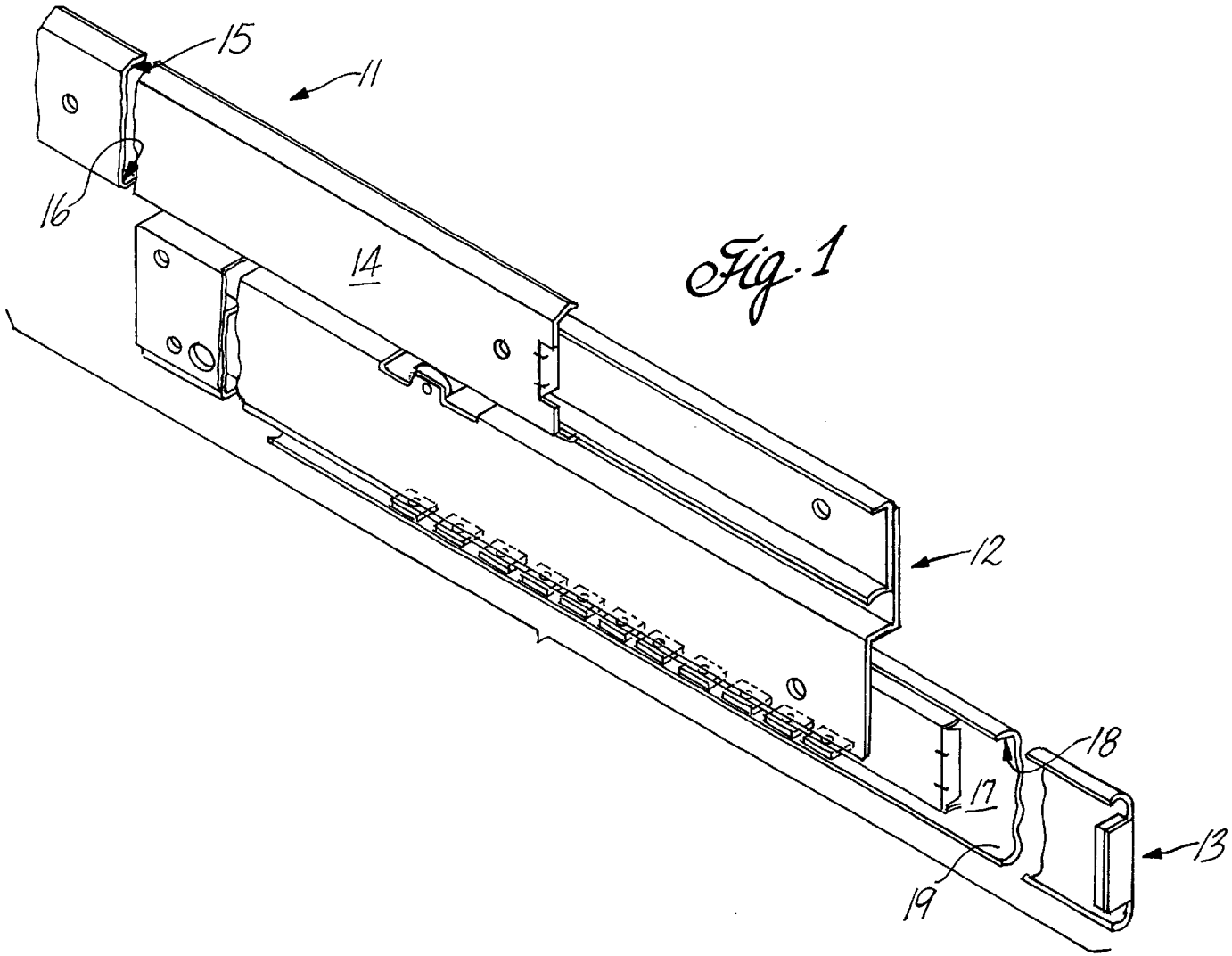
FIG. 1 is an isometric view of a drawer slide assembly.

As the name implies, a three member vertical drawer slide generally has three main members. As shown in FIG. 1, three member vertical drawer slides have an upper slide member 11, a tie member 12, and a lower slide member 13. The upper slide member has a vertical web 14 and upper and lower arcuate inward facing ball bearing raceways 15, 16 extending substantially horizontally from the upper and lower margins, respectively, of the vertical web 14. The ball bearing raceways 15, 16 are termed inward facing because the pair of raceways face towards each other, and towards a center axis of the vertical web. Conversely, a pair of outward facing ball bearing raceways face away from each other and the center axis of the vertical web. The lower slide member also has a vertical web 17 and upper and lower arcuate inward facing ball bearing raceways 18, 19 extending substantially horizontally from the upper and lower margins, respectively, of the vertical web. The upper and lower slide members are slidably coupled to opposing sides of the intermediate member. The upper and lower slide members therefore face in opposing directions. Thus, the web of one slide member, which will be the upper slide member for purposes of exposition, may be attached to the side wall of a drawer while the web of the other slide member, in this case the lower slide member, may be attached to a cabinet containing the drawer.

The upper and lower slide members are also substantially vertically aligned. That is, the upper slide member is coupled to the tie member substantially vertically above where the lower slide member is coupled to the tie member. Vertically positioning the upper and lower slide members with respect to one another provides a slim drawer slide cross-section, and thereby allows for a minimum amount of space between drawer and cabinet.

The tie member of a three member vertical drawer slide is shown in end view in FIG. 4. The tie member consists of three separate parts. The tie member has an intermediate member 100, an upper slide member connector 120, and a lower slide member connector 200. The intermediate member 100 comprises an upper vertical flange 102 horizontally offset from a lower vertical flange 104. A substantially horizontal cross piece 106 connects the upper and lower flanges. The upper flange ascends from one margin of the cross piece 106 and the lower flange descends from the opposing margin of the cross piece. As a matter of convenience, the sides of the flanges directed away from the connecting cross piece shall be termed the outside faces of the flanges. Similarly, the sides of the flanges directed towards the connecting cross piece, and thus the opposite side of the flange, shall be termed the attaching faces of the flanges.

The upper slide member connector 120 and the lower slide member connector 200 are affixed through welding or other methods to the intermediate member 100. As shown in FIG. 4A, the upper slide member connector is attached to an emboss 140 projecting from the attaching face of the upper vertical flange 102. In one embodiment, the members will be welded together, and the emboss 140 further defines a weld projection 160. In another embodiment, illustrated by FIG. 4B, the members are riveted together, and the emboss 140 defines an aperture, such as a pilot hole. In other embodiments, the members are attached by a locking process which deforms the members together, as shown in FIG. 4C, or attached by a fastener, as shown in FIG. 4D. Regardless of the method of attaching the members to each other, outside of the point of attachment, the channel 220 between the members is maintained.

The lower slide member connector 200 is attached to the attaching face of the lower vertical flange 104. The upper slide member connector 120 is therefore positioned substantially over the cross piece 106, and the lower slide member connector 200 is therefore positioned substantially below the cross piece 106.

The upper slide member connector 120 has a vertical web 122 and arcuate upper and lower vertically outward facing ball bearing raceways 124, 126 extending from the upper and lower margins, respectively, of the web 122. The lower slide member connector, like the upper slide member connector, has a vertical web 202 and arcuate upper and lower vertically outward facing bearing raceways 204, 206.

The present invention has been described and illustrated with respect to a presently preferred embodiment, but, in its broader aspect, is not limited to the specific details shown and described herein. Departures may be made from such details without departing from the principles of the invention and without sacrificing its chief advantages.

What is claimed is:

1. An assembly, comprising:

a plurality of members, each member having at least one attaching face, for attaching the member to another member such that the respective attaching faces of the attached members substantially abut; and an emboss protruding from an attaching face of a member of the plurality, for attaching the member to another member from the plurality such that the emboss contacts the attaching face of another member, while providing a gap between the members;

wherein the attachment face of each of the plurality of members defines at least one protruding emboss; and wherein each member is selectively attached to another member where an emboss of one member abuts the attaching face of another member.

2. An assembly as in claim 1, wherein the plurality of members includes an intermediate member, a first slide coupling member and a second slide coupling member, the first slide coupling member attached to the intermediate member where an emboss of the intermediate member abuts the first slide coupling member, and the second slide coupling member attached to the intermediate member where an emboss of the intermediate member abuts the attaching face of the second slide coupling member.

3. An assembly as in claim 1, wherein the emboss of a first member further defines a projection for projection welding the first member to the attachment face of the second member.

4. An assembly as in claim 1, wherein the emboss of the first member further defines an aperture for coupling the first member to the attachment face of a second member.

5. A drawer slide assembly comprising:

a plurality of members attached together at protruding contact points located at spaced intervals along each of the members, the members forming channels therebetween each other, wherein the protruding contact points along any member protrudes toward and contacts another member.

6. A drawer slide assembly as in claim 5, wherein the members are attached by welding at the protruding contact points.

7. A drawer slide assembly as in claim 5, wherein the members are attached by fasteners at the protruding contact points.

8. A drawer slide assembly as in claim 5, wherein the members are attached together by deforming the members into each other at the protruding contact points by swedging.

9. A drawer slide assembly comprising:

an intermediate tie member, having at least two attaching faces;

a first coupling member, having an attaching face for attaching to an attaching face of the intermediate member;

a second coupling member, having an attaching face for attaching to an attaching face of the intermediate member; and an emboss protruding from a member, for attaching that member to another member such that a gap is formed between the attaching faces;

wherein the attaching faces of each coupling member or the tie member has at least one emboss protruding from said faces.

10. A drawer slide assembly, comprising:

a tie member; and a coupling member;

wherein an emboss protrudes from each member and contacts another member, and the members are attached to each other at the point of contact between the members.

11. A drawer slide assembly, comprising:

a tie member, having upper and lower longitudinal webs oriented in substantially vertical planes, offset by a substantially horizontal member, wherein the webs each have an attaching face disposed toward the horizontal member;

an upper slide connector member, having a longitudinal web oriented in a substantially vertical plane, substantially parallel to and facing the attaching face of the upper longitudinal web of the tie member;

a lower slide connector member, having a longitudinal web oriented in a substantially vertical plane, substantially parallel to and facing the attaching face of the lower longitudinal web of the tie member;

a raised surface on the tie member and on the upper and lower slide connector members defining a point of contact between the facing webs, where the members are attached to each other, such that the remaining surfaces of the webs are not in contact with each other.

12. An assembly, comprising:

a plurality of members, each members having at least one attaching face, for attaching the member to another member such that the respective attaching faces of the attached members substantially abut; and an emboss protruding from an attaching face of a member of the plurality, for attaching the member to another member from the plurality such that the emboss contacts the attaching face of another member, while providing a gap between the members;

wherein the plurality of members includes a first member and a second member attached to each other, the first member having at least one emboss protruding from its attaching face and abutting the attaching face of the second member, such that the emboss abuts the attaching face of the second member, while providing a gap between the first and second members, and wherein the second member also has at least one emboss protruding from its attachment face.

13. An assembly as in claim 12, wherein the emboss of the first member is attached to the attaching face of the second member by welding.

* * * * *